US007804973B2

(12) United States Patent
De Vries et al.

(10) Patent No.: US 7,804,973 B2
(45) Date of Patent: Sep. 28, 2010

(54) FITTING METHODOLOGY AND HEARING PROSTHESIS BASED ON SIGNAL-TO-NOISE RATIO LOSS DATA

(75) Inventors: Aalbert De Vries, Eindhoven (NL); Rob Anton Jurjen De Vries, Eindhoven (NL)

(73) Assignee: GN ReSound A/S (DK)

( * ) Notice: Subject to any disclaimer, the term of this patent is extended or adjusted under 35 U.S.C. 154(b) by 1095 days.

(21) Appl. No.: 10/422,258

(22) Filed: Apr. 24, 2003

(65) Prior Publication Data

US 2004/0047474 A1 Mar. 11, 2004

(30) Foreign Application Priority Data

Apr. 25, 2002 (DK) ..... 2002 00618

(51) Int. Cl.
*H04R 25/00* (2006.01)
*H04R 29/00* (2006.01)

(52) U.S. Cl. ..... 381/317; 381/60; 381/312; 381/313; 381/314

(58) Field of Classification Search ..... 381/60, 381/312, 316–318, 313, 314, 104, 306; 600/559; 73/585; 700/94
See application file for complete search history.

(56) References Cited

U.S. PATENT DOCUMENTS 4,548,082 A 10/1985 Engebretson et al.
4,759,070 A * 7/1988 Voroba et al. ..... 381/60
6,104,822 A 8/2000 Melanson et al.
6,167,138 A 12/2000 Shennib ..... 381/60
6,876,749 B1 * 4/2005 Killion et al. ..... 381/122
2002/0037087 A1 3/2002 Allegro
2002/0191799 A1 * 12/2002 Nordqvist et al. ..... 381/60

FOREIGN PATENT DOCUMENTS

WO WO 01/52242 A1 1/2001
WO WO 01/76321 A1 * 10/2001

OTHER PUBLICATIONS

Killion, Mead C.; "What Can The Pure-Tone Audiogram Tell Us About A Patient's SNR Loss"; The Hearing Journal, Mar. 2000, vol. 53, No. 3, pp. 46-53.

* cited by examiner

*Primary Examiner*—Vivian Chin
*Assistant Examiner*—Douglas J Suthers
(74) *Attorney, Agent, or Firm*—Vista IP Law Group, LLP.

(57) ABSTRACT

An individual with a hearing loss often experiences at least two distinct problems: 1) the hearing loss itself i.e. an increase in hearing threshold level, and 2) a signal-to-noise ratio loss (SNR loss) i.e. a loss of ability to understand high level speech in noise as compared to normal hearing individuals. According to one aspect of the present invention, this problem is solved by selecting parameter values of a noise reduction algorithm or algorithms based on the individual user's SNR loss. Thereby, a degree of restoration/improvement of the SNR of noise-contaminated input signals of the hearing prosthesis has been made dependent on user specific loss data. According to another aspect of the present invention, a hearing prosthesis capable of controlling parameters of a noise reduction algorithms in dependence on the user's current listening environment as recognized and indicated by the environmental classifier has been provided.

34 Claims, 2 Drawing Sheets

FITTING METHODOLOGY AND HEARING PROSTHESIS BASED ON SIGNAL-TO-NOISE RATIO LOSS DATA

RELATED APPLICATION DATA

This application claims priority to and the benefit of Danish Patent Application No. 2002 00618, filed on Apr. 25, 2002.

FIELD OF THE INVENTION

The present invention relates to a method of fitting a hearing prosthesis to requirements of a hearing impaired individual based upon estimated, or measured, loss data that characterize the hearing impaired individual's signal-to-noise ratio loss. Another aspect of the invention relates to a hearing prosthesis which comprises an environmental classifier adapted to recognize different listening environments and control a noise reduction amount in the hearing prosthesis in response to the hearing impaired individual's current listening environment.

BACKGROUND OF THE INVENTION

Mead C. Killion and Patricia A. Niquette: "What can the pure-tone audiogram tell us about a patient's SNR loss?", The Hearing Journal 53-3, March 2000 discloses various studies revealing that the amount of signal-to-noise ratio loss (SNR loss) for a patient with a sensorineural hearing impairment can not be accurately predicted from the audiogram. The audiogram measures (audiometric) hearing loss, the loss of sensitivity for sounds. Hearing loss can be appropriately restored by amplification of the incoming sounds. For most hearing impaired patients, the performance in speech-in-noise intelligibility tests is worse than for normal hearing people, even if the audibility of the incoming sounds is restored by amplification. The term SNR loss is defined as the average increase in signal-to-noise ratio (SNR) needed for a hearing impaired patient relative to a normal hearing person in order to achieve similar performance (50% word recognition) on a hearing in noise test, at levels above the hearing threshold. Killion found that SNR loss is relatively independent from hearing loss for most sensorineaural hearing impaired patients. Consequently, in order to determine the SNR loss for a specific patient, one needs to measure it, rather than make a guess based on the hearing loss (audiogram).

Thus, hearing impaired individuals or patients often experience at least two distinct problems: a hearing loss, which is an increase in hearing threshold level, and SNR loss, which is a loss of ability to understand high level speech in noise in comparison with normal hearing individuals.

SNR loss is traditionally estimated by measuring a speech reception threshold (SRT) of the hearing impaired individual. An individual's SRT is the signal-to-noise ratio required in a presented signal to achieve 50% correct word recognition in a hearing in noise test.

Hearing loss is typically caused by a loss of outer hair cells and conductive loss in the middle ear, while SNR loss is typically caused by a loss of inner hair cells. On average, a hearing loss of 30 to 70 dB is accompanied by a 4-7 dB SNR loss, cf. QuickSIN™ Speech in Noise Test available from Etymotic Research. However, accurate estimates of the SNR loss for a given hearing impaired individual can only be obtained by specific testing since the increase in hearing threshold level, which is measured by traditional pure-tone audiograms, and SNR loss appear to be independent characteristics.

Today's digital hearing aids that use multi-channel amplification and compression signal processing can readily restore audibility of amplified sound for a hearing impaired individual or patient. The patient's hearing ability can thus be improved by making previously inaudible speech cues audible. Loss of capability to understand speech in noise due to the above-mentioned SNR loss is accordingly the most significant problem of most hearing aid users today.

Compensating for the patient specific SNR loss has, however, proven far more difficult. While some single observation processing algorithms are able to improve an objective signal-to-noise ratio (SNR) of a noise-contaminated input signal, such as a microphone signal, a difficulty lies in the fact that filtering, i.e. attenuating or removing, noise components from the input signal introduces various artifacts into the desired signal (typical speech). These artifacts generally lead to a loss of speech cues and the single observation processing algorithms therefore fail to improve the patient's hearing ability in noisy listening environments. The most successful technique to improve the SNR of noise-contaminated speech signals has been to utilize a multi-observation system, such as a microphone array, which may contain from 2 to 5 individual microphones. An array microphone system exploits spatial differences between a desired, or target, signal and interfering noise sources. Unfortunately, many of these microphone array systems are not practical for hearing aid applications because of their accompanying requirements to surface area on a housing of the hearing prostheses. Cost and reliability issues are other factors that tend to make microphone arrays less attractive for many hearing aid applications.

Even though an ultimate goal of noise reduction systems and algorithms in hearing aids should be to improve the user's ability to hear in noise by compensating for the user's SNR loss, improving the patient's listening comfort through noise reduction is also a worthwhile achievement. In this latter situation, listening may be less tiring for the user and as such indirectly improves long-term intelligibility of noise contaminated speech signals.

As mentioned above, there exist a number of single observation and multiple observation algorithms and systems to reduce interfering noise from a target signal, e.g. speech. Since each of these algorithms and systems is associated with certain costs, there is a need for defining a strategy for selecting and applying these different noise reduction algorithms both during a fitting procedure and during normal operation of the hearing prosthesis. According to one aspect of the present invention, this problem is solved by selecting parameter values of a noise reduction algorithm or algorithms based on the patient's measured or estimated SNR loss Thereby, a degree of restoration/improvement of the SNR of noise-contaminated input signals of the hearing prosthesis has been made dependent on patient specific loss data. According to another aspect of the present invention, a hearing prosthesis capable of controlling parameters of a noise reduction algorithms in dependence on the user's current acoustic subspace, or listening environment, as recognized and indicated by the environmental classifier has been provided.

SUMMARY OF THE INVENTION

A first aspect of the invention relates to a method of fitting a hearing prosthesis to a hearing impaired individual, the method comprising steps of:

providing estimated or measured loss data that represent the hearing impaired individual's signal-to-noise ratio loss in a fitting system, providing a data communication link between the hearing prosthesis and the fitting system, determining parameter values of a noise reduction algorithm of the hearing prosthesis based on the loss data to set a noise reduction amount of an input signal of the hearing prosthesis, storing the parameter values within a persistent data space in the hearing prosthesis.

According to the invention, the noise reduction amount, or restoration of the SNR, in an input signal of the hearing prosthesis is dependent on specific, estimated or measured, loss data of the hearing impaired individual or patient. The SNR loss of the patient may be fully or partly compensated, or even overcompensated, so that a determined 5 dB SNR loss may be accompanied by selected parameter values of the noise reduction algorithm which provide e.g. between 2 and 8 dB of noise reduction, or SNR improvement. Accordingly, a target noise reduction amount may be selected so as to substantially restore the hearing impaired individual's hearing ability to that of a normal hearing individual in a standardized hearing in noise test. By selecting parameter values of the noise reduction algorithm which provide a noise reduction amount larger than the estimated SNR loss of the patient, it may even be feasible to improve the patient's' hearing ability relative to that of a normal hearing individual. A fitting program may automatically select the noise reduction amount through an appropriate selection of the parameter values of the noise reduction algorithm based on the loss data. Alternatively, a dispenser may manually or semi-automatically select the desired noise reduction amount from presented patient specific loss data.

In the present specification and claims the "SNR loss" of a hearing impaired individual means a required increase in SNR of a presented signal for the hearing impaired individual relative to a normal hearing person in order to achieve substantially similar hearing performance in a standardized hearing in noise test. As an example, the standardized test may measure 50% correct word recognition on a hearing in noise test at signal levels above the hearing threshold. The SNR loss may conveniently be expressed in dB.

The SNR loss of the patient may be estimated by measuring the patient's SRT. The measurement of the patient specific SNR loss may conveniently be implemented as an auxiliary measurement module, or measurement option, in a hearing aid fitting system. Alternatively, the SNR loss of the patient may be derived from hearing threshold level data through an appropriate prescriptive procedure. The determination of the parameter values of the noise reduction algorithm of the hearing prosthesis may be provided as described in detail in the embodiment of the invention disclosed with reference to the figures. As a simple example, it may have been determined through an appropriate procedure that a particular patient suffers from 3 dB SNR loss. This patient could be fitted with a hearing prosthesis that contains a noise reduction algorithm or agent based on beam forming of signals from a microphone array. In order to substantially fully restore the hearing ability of this patient in noisy acoustic conditions, parameters values of the beam forming algorithm may be selected to provide a beam formed, or directional, microphone signal with a noise reduction amount of 3 dB, i.e. a SNR improvement of 3 dB, under specified acoustic conditions, e.g. diffuse field conditions. This noise reduction amount can be achieved by setting appropriate parameter values of the beam-forming algorithm or beam forming system so that a desired directional pattern of the directional microphone signal is obtained.

The noise reduction algorithm may comprise several different noise reduction algorithms and the target noise reduction amount can in that situation be achieved by distributing the target noise reduction amount between the different noise reduction algorithms in a suitable manner. According to a preferred embodiment of the invention, the noise reduction algorithm comprises a noise reduction algorithm based on beam forming, i.e. spatial filtering, in combination with a single observation based noise reduction algorithm and respective parameter values.

The data communication link between the hearing prosthesis and the fitting system may comprise a wireless or wired data interface. A wired or wireless serial bi-directional data interface is preferably used. The data communication link may comprise an industry-standard programming box such as the Hi-Pro device.

The persistent data space of the hearing prosthesis may be placed in an EEPROM or Flash memory device or any other suitable memory device or combination of memory devices capable of retaining stored data during periods where a normal voltage supply of the hearing prosthesis is interrupted.

A second aspect of the invention relates to a hearing prosthesis fitting system adapted to perform a fitting methodology as described above. The fitting system may comprise a host computer such as Personal Computer controlled by suitable fitting program and an industry-standard programming box. The programming box may also serve as a galvanic isolation between the host computer and the hearing prosthesis itself. A hand-held computing device such as a suitably programmed Personal Digital Assistant may alternatively constitute or form part of the fitting system.

A third aspect of the invention relates to a hearing prosthesis for a hearing impaired individual, comprising an input signal channel providing a digital input signal, an environmental classifier that is adapted to analyze the digital input signal for predetermined signal features to indicate respective recognition probabilities for different listening environments, a processor that is adapted to process the digital input signal in accordance with one or several noise reduction algorithms and associated algorithm parameters to generate a noise reduced digital signal, control a noise reduction amount of the noise reduced digital signal based on the recognition probabilities indicated by the environmental classifier;

wherein the parameter set of the environmental classifier has been selected to be substantially identical to a training-phase parameter set determined during a training phase of an environmental classifier of the same type.

The training phase comprises applying a collection of predetermined sound segments, representative of the different listening environments, to an environmental classifier of the same type as that of the hearing prosthesis and to noise reduction algorithms of the same type or types as that/those of the hearing prosthesis to produce a collection of noise-reduced predetermined sound segments; The training phase further comprises adapting parameter values of the training-phase environmental classifier in a manner that minimizes a perceptual cost function associated with the collection of noise-reduced predetermined sound segments to produce the training-phase parameter set.

A hearing prosthesis according to the present invention may be embodied as a BTE, ITE, ITC, and CIC type of hearing aid or as a cochlear implant type of hearing loss compensation device. The hearing prosthesis preferably comprises one or two microphones with respective preamplifiers and analogue-to-digital converters to provide one or two digital input signals representative of the microphone signal or signals.

The environmental classifier analyses the digital input signal or signals, or a signal derived from this or these, such as a directional signal, for predetermined signal features to determine respective probabilities, or classification results, for the different listening environments. The predetermined signal features may be temporal features, spectral features or any combination of these. A listening environment may be constituted by one of the following types of signals or any combination of these: clean speech, speech mixed with babble noise, speech and any type of noise at a specific SNR, music, traffic noise, cafeteria noise, interior car noise, etc.

The environmental classifier may form part of the processor or may be embodied as an application specific circuit communicating with the processor in accordance with a predetermined protocol. In a preferred embodiment of the invention, the environmental classifier comprises an executable set of program instructions for a proprietary Digital Signal Processor (DSP). The processor may accordingly comprise a programmable processor such as a DSP or a microprocessor or a combination of these.

According to the present invention, the environmental classifier of the hearing prosthesis is not explicitly trained to detect and categorize various predetermined listening environments, or acoustic sub-spaces, as well as possible but adapted to minimize the perceptual cost of applying the noise reduction algorithms to the digital input signal.

This is achieved because the parameter set of the environmental classifier has been selected to be substantially identical to the training-phase parameter set determined during the training phase of the environmental classifier of the same type. The purpose of the training phase is to determine that particular parameter set for the training-phase environmental classifier that minimizes the perceptually based cost function on the collection predetermined sound segments, i.e. sound segments that are relevant because they are representative of listening situations or environments which are common and important in the hearing impaired user's daily life.

The categorization of the user's various daily listening environments, which can be derived from the indicated probabilities of the environmental classifier in the hearing prosthesis during its use, can be interpreted as a by-product of the adaptation of the training-phase environmental classifier.

The training phase may further have comprised adapting the parameter values of the training-phase environmental classifier so as to obtain a target signal-to-noise ratio improvement to the collection of noise-reduced predetermined sound segments. Thereby, a corresponding noise reduction amount is applied to the digital input signal of the hearing prosthesis through due to a coupling between the training-phase parameter set of the training phase environmental classifier and the on-line parameter set utilized by the environmental classifier of the hearing prosthesis.

A plurality of environmental classifiers, or separate parameter sets of a single environmental classifier, may be trained to provide respective target noise reduction amounts to the collection of predetermined sound segments during the training phase. Thereby, characteristics of each environmental classifier, or of each parameter set, may be tailored to a particular group of hearing impaired individuals with a common prescriptive requirement due to their SNR loss or range of SNR losses.

The plurality of environmental classifiers, or parameter sets, is preferably trained to provide a range of target noise reduction amounts distributed between 1 and 10 dB, e.g. in steps of 1 or 2 dB, to the collection of predetermined sound segments. The persistent data space of the hearing prosthesis may store all or at least some parameter sets for the environmental classifier that are identical to these training-phase parameter sets. A suitable active parameter set in the hearing prosthesis can thereafter automatically, or manually, be selected during the fitting procedure in accordance with estimated or measured loss data that represent the hearing impaired individual's signal-to-noise ratio loss.

An attractive feature of the present aspect of the invention is that the entire acoustic space in which the hearing prosthesis is intended to function can be divided into a collection of differing listening environments. Each of these listening environments may be associated with an, in some sense, optimal noise reduction algorithm. The optimal noise reduction algorithm is selectively applied to the digital input signal in accordance with the recognition probabilities indicated by the environmental classifier. An advantage of this approach is that a designer/programmer of a particular noise reduction algorithm may tailor characteristics of that noise reduction algorithm to a priori known signal or noise features that are characteristic for a particular target listening environment.

This approach to noise reduction accordingly operates by a divide-and-conquer approach to noise reduction. For some of the different listening environments, such as clean speech or speech with a high SNR, the optimum solution for noise reduction may be to completely turn off the noise reduction algorithm or algorithms, i.e. setting the noise reduction amount to zero, to avoid potential artifacts and reduce computational load on the processor.

Accordingly, each noise reduction algorithm may be associated with a particular predetermined listening environment or associated with a set of predetermined listening environments in case that the noise reduction algorithm in question has been found useful for several different environments. Noise reduction algorithms based on various techniques such as beam forming, spectral subtraction, low-level expansion, speech enhancement may be usefully applied in the present invention.

The amount of noise reduction may be controlled by regulating parameters values of a noise reduction algorithm or respective parameter values of several noise reduction algorithms. Alternatively, or additionally, the amount of noise reduction may be obtained by regulating respective scaling factors of a gating network connected between each noise reduction algorithm and a summing node that combines processed signal contributions from all operative noise reduction algorithms. The noise reduction amount provided by the noise reduction algorithm or algorithms has preferably been set in dependence on estimated or measured loss data that characterize a user's SNR loss. Therefore, the SNR loss of the user or patient may be fully or partly compensated, or even overcompensated. Preferably, the noise reduction amount is set so as to substantially compensate the user's signal-to-noise ratio loss. Thereby, restoring the user's hearing capability and allowing the user to perform comparable to an average normal hearing individual in a standardized hearing in noise test.

The noise reduction algorithm or the plurality of noise reduction algorithms may comprise a cascade of a spatial filtering based algorithm and a single observation based noise reduction algorithm. The spatial filtering may comprise a fixed or adaptive beam-forming algorithm applied to a set of microphone signals provided by two closely spaced omnidirectional microphones mounted on a housing of the hearing prosthesis.

The noise reduction amount provided in the hearing prosthesis is preferably programmable and controllable from a fitting system. The fitting system may be adapted to allow an operator to adjust the parameters of the environmental classifier or select a particular environmental classifier from a set of environmental classifiers. Since the noise reduction amount is based on the indicated recognition probabilities of the classifier, adjusting the parameters of the environmental classifier or changing between different environmental classifiers, also adjusts the amount of noise reduction applied to the digital input signal.

A fourth aspect of the invention relates to a method of fitting a hearing prosthesis to a hearing impaired individual, the method comprising steps of:

providing a data communication link between the hearing prosthesis and a fitting system, providing estimated or measured loss data that represent the hearing impaired individual's signal-to-noise ratio loss in the fitting system, providing an environmental classifier and a number of different parameter sets for the environmental classifier; the different parameter sets being selected to produce different noise reduction amounts in the hearing prosthesis, selecting a parameter set for the environmental classifier based on the loss data, storing the selected parameter set and optionally also the environmental classifier within a persistent data space in the hearing prosthesis.

The different parameter sets for the environmental classifier may be substituted by a set of different environmental classifiers each being adapted to produce a target noise reduction amount.

The different parameter sets for the environmental classifier, or the set of different environmental classifiers, may be provided on a storage media of a hearing aid fitting system adapted to provide the present fitting methodology. When the desired environmental classifier, or the desired parameter set, has been identified in the fitting procedure, it is transmitted to the persistent data space of the hearing prosthesis through the data communication link. The environmental classifier may, alternatively, have been preloaded into the persistent data space of the hearing prosthesis during the manufacturing. In that situation only the selected parameter set need to be transmitted to the hearing prosthesis and stored within the persistent data space in connection with the fitting procedure. In yet another alternative, the set of different environmental classifiers, or the different parameter sets, has been preloaded in the persistent data space during manufacturing of the hearing prosthesis. Thereby, selecting the desired environmental classifier, or the desired parameter set, merely amounts to indicating e.g. through a data pointer the desired classifier or desired parameter set of the classifier in the persistent data space.

Preferably, at least some of the different parameter sets for the environmental classifier have been obtained in a training phase of an environmental classifier of the same type as the environmental classifier provided in the hearing prosthesis. The preferred training procedure is described in detail below with reference to the figures.

BRIEF DESCRIPTION OF THE DRAWINGS

In the following, specific embodiments of a hearing aid fitting system and DSP based hearing aid according to the invention are described and discussed in greater detail.

DESCRIPTION OF PREFERRED EMBODIMENTS

According to the present embodiment of the invention, a noise reduction system comprising a network of different signal processing algorithms or agents is provided in a DSP based hearing aid. The various agents are adapted to reduce the unwanted signals (noise, reverberation, feedback) in the system. These noise-reduction agents are collectively called noise reduction agents in the present preferred embodiment of the invention. In general, signal processing agents in hearing aids need not to be limited to noise reduction and the disclosure presented here applies to a more general signal processing framework as well.

Figure 1:
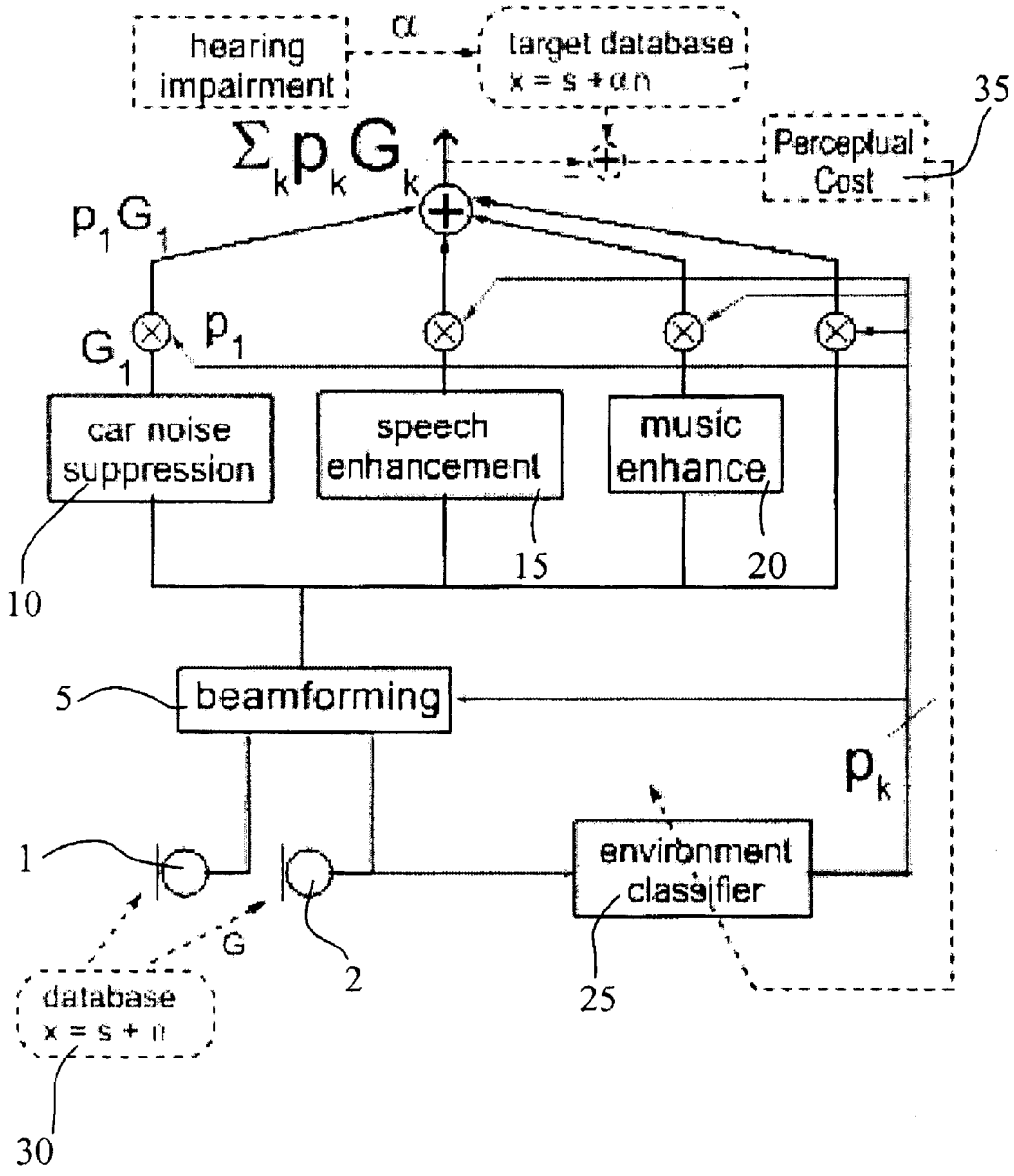
FIG. 1 illustrates a network configuration with three example noise reduction agents.

An example is depicted in FIG. 1, where we have a network that comprises a beam former agent 5, a car noise suppression agent 10, speech enhancement agent 15 and music enhancement agent 20. The beam former agent 5 comprises a closely spaced pair of omni-directional microphones 1, 2 and respective input signal channels (not shown) with analogue-to-digital converters. The beam former agent 5 also comprises means that applies digital processing operations to a pair of microphone signals derived from the omni-directional microphone pair 1, 2 to form a directional, or spatially filtered, digital signal with adjustable spatial reception characteristics.

The best system performance of the present hearing aid in terms of intelligibility and comfort is not obtained when all signal processing agents 5, 10, 15 and 20 are operative at full force at all times. The music enhancement agent 20 is preferably only active when music segments are applied to the microphones 1, 2. Hence, an environmental classifier 25 has been provided and adapted to detect presence/absence of music and turn the music enhancement agent 20 accordingly on or off.

Some noise-reduction agents however are not so specific for a well-defined acoustic subspace such as music or car environment. For instance, it is hard to determine a priori under what acoustic conditions a generic spectral subtraction based noise reduction agent can be usefully applied. According to the present embodiment of the invention, a method to determine the appropriate acoustic conditions for turning any noise reduction agent on or off (or even partly active) is disclosed.

In FIG. 1, the outputs $p_k$ of the environmental classifier 25 control the impact of the gain scaling elements $G_k$ of the various noise reduction agents 5, 10, 15 and 20, depending on the state (recent history) of the acoustic input. The environmental classifier outputs may additionally control specific parameters within one or several of the noise reduction agents.

The processing of signals occurs in 2 phases. We distinguish between a training phase and an operative phase.

The training phase is preferably carried out at the manufacturing stage and involves determining a set of environmental classifiers or parameters for a single environmental classifier which can be stored in a fitting system adapted to fit hearing aids in accordance with the present embodiment of the invention, or which can be stored in a EEPROM location of the hearing aid before it is shipped to a dispenser.

The operative phase refers to normal use of the hearing aid, i.e. under circumstances where the hearing aid is in its operational state on the patient.

In the training phase, a collection of representative sound segments, including speech and music under adverse conditions (with noise) is available. These sound segments may conveniently be stored in a digital format in a computer database symbolically illustrated as item 30 of FIG. 1. We have furthermore available a desirable level of signal-to-noise ratio (SNR) improvement to be achieved by the network of noise reduction agents. This desired level of SNR improvement is patient specific and can be estimated from a commercially available hearing in noise test such as the QuickSIN™ or other comparable speech in noise test, cf. QuickSIN™ Speech in Noise Test available from Etymotic Research.

For the collection of sound segments, we derive desired output signals after processing by the noise reduction agents, e.g. by applying an off-line model of the signal processing operation of each of the noise reduction agents 5, 10, 15 and 20 that are operational in the hearing aid to the sound segments or files.

If we denote a pre-processed database sound segment by s+n, then the desired or target processed sound segment is s+γn, where s is the target (speech, music) signal, n represents the unwanted signal such as broad-band white noise, babble noise or subway noise, and −20 log(γ) dB is the target SNR improvement in decibel.

A perceptually inspired cost function 35 then computes a distance between the target sound segment s+γn and the actually processed sound segment or signal. As an example, the sum of differences of a log-spectrum on a bark frequency scale constitutes a preferred and relevant cost (distance) function. Other cost functions are also possible. The goal of the training phase is to adapt the parameters of the environmental classifier such that the selected cost function 35 accumulated over all sound segments within the collection in database 30 is minimized.

The above-mentioned adaptation scheme is a well-known "machine learning" type of application. We choose an environmental classifier that controls the parameters of the noise suppression agent or agents 5, 10, 15 and 20 such that the target y(t)=s(t)+g*n(t) is obtained as closely as possible for the inputs x(t)=s(t)+n(t). The classifier 25 is therefore a parameterized learning machine such as a Hidden Markov Model, neural network, fuzzy logic machine or any other machine with adaptive parameters and can be trained by learning mechanisms that are well-known in the art such as back propagation, see for example "P. J. Werbos. Back propagation through time: What it does and how to do it. Proceedings of the IEEE, 78(10):1550--1560, 1990"; or see "Jacobs R. A., Jordan M. I., Nowlan S. J., and Hinton G. E., Adaptive mixtures of local experts, Neural Computation, vol. 3, pp. 79-87, 1991".

During the training phase, separate environmental classifiers or separate parameter sets of a single environmental classifier are trained for an appropriate range of values for γ. For example, the environmental classifiers can be trained for values of γ between 1-20 dB in steps of 1 or 2 dB, or more preferably for values γ between 3-10 dB in 1 dB steps.

An important aspect of the present embodiment of the invention is that the proposed environmental classifier 25 does not detects a priori declared acoustic categories such as speech, car noise, music etc. The classifier 25 is trained to optimize a cost function on a database 30 of relevant sound segments. By training a plurality of environmental classifiers, or separate parameter set of a single environmental classifier, for a range of SNR ratio improvements, it is possible, during the fitting session, to choose a patient-specific environmental classifier or a patient-specific parameter set for the environmental classifier based the patient's SNR loss.

The proposed optimization methodology leads to a categorization of the acoustic space that can be seen as a by-product of the training phase and not a priori declared by the designer. The categorization is therefore implicit and does not have to conform to predetermined categories such as clean speech, noise, music etc. The environmental classifier 25 may during the operative phase directly control parameters of one or several of the provided noise reduction agents without an intermediate step of the acoustic categorization.

At the end of the training phase, a number of environmental classifiers may have been provided and each environmental classifier trained for a particular target SNR improvement. Data representing these environmental classifiers, or their respective parameters, may be stored on a suitable storage media and loaded into a host computer that forms part of the fitting system. In order to choose a specific environmental classifier or classifiers for the operative phase, it is preferred to measure the patient's SNR loss during the fitting procedure.

As an example, consider a noise reduction system or network (or a configuration of noise reduction algorithms, e.g. a beam forming noise reduction algorithm based on two or more microphone signals followed by a spectral enhancement algorithm) and associate a variable α with the target SNR restoration, or desired improvement. Thus, the variable α represents the desired, or target, amount of noise reduction that a particular hearing impaired individual, or a particular group of hearing impaired individuals, should be provided with to restore their hearing ability/abilities in noise to a predetermined level of performance.

In a user interface of the fitting system, α may take on one of the values of the categorical set {none, mild, moderate, strong} or one of the numerical set {0, 1, 2, . . . , 20 dB}. A chosen value for α thereafter determines the values for the algorithm parameters in the noise reduction algorithm. For example, when the noise reduction algorithm is based on spectral subtraction, the output signal of the noise reduction algorithm is given by $$Y(f) = \left(1 - \beta\frac{|N_{est}(f)|}{|X(f)|}\right)X(f)$$

Where X(f), $N_{est}$(f) and Y(f) denote Fourier transforms of an input signal, such as a microphone signal, an estimated noise signal and the output signal, respectively.

The constant scalar β regulates the obtained amount of noise reduction. In the ideal case ($N_{est}$ equals the true noise) the SNR improvement on the output is equal to 20 log(1/(1-β)) dB. Hence, in this case, β is set to $$\beta = 1 - 10^{-\alpha/20}$$

The goal of the fitting procedure is to determine α and thereby calculate or determine corresponding parameter values for the noise reduction algorithm or algorithms. For an ideally operating spectral subtraction agent, β makes it possible to derive appropriate parameter values for the spectral subtraction agent.

The target amount of noise reduction may be estimated (extrapolated) from the audiogram based on a prescriptive methodology or measured in the beginning of the fitting procedure. If α is set too low, the patient will not fully recover speech intelligibility in a noisy acoustic environment and cannot perform comparable to that of a normal hearing person. If α is set too high, comfort of amplified and processed sound delivered by the hearing aid will likely be compromised since noise reduction algorithms tend to distort the input signal more for greater values of α.

Hence, the below mentioned systematic method for setting α, i.e., the degree of desired noise reduction in the hearing aid, is of great value.

1. measure the patient specific SNR loss.

Various methods for estimating SNR loss in a patient have been proposed. Issues here are prediction accuracy and measurement time.

2. set $\alpha$ to a value that is derived from the patient's estimated SNR loss, such as to patient's SNR loss.

The goal is to apply a noise reduction algorithm that restores the patient's SNR loss in order to provide a listening experience as close as possible to a normal hearing person.

3. set the noise reduction algorithm parameters to values that correspond with the chosen value for $\alpha$ Then, for the operative phase we use the environmental classifier whose trained SNR improvement matches, according to some predetermined criteria, the patient's SNR loss. During the operative phase, the environmental classifier directly or indirectly controls the impact of the various noise reduction agents by controlling signals $p_k(t)$.

For many acoustic environments it is not only unclear whether certain noise reduction agents should be turned on, off or be partly active, but also whether these noise reduction agents should be placed in parallel or in series (or be partially in parallel and series) to other noise reduction agents. In the below disclosure a network configuration is given in which not only the emerging categorization of the acoustic space but also the emerging network structure is a product of the training phase and not a priori declared by the designer.

Figure 2:
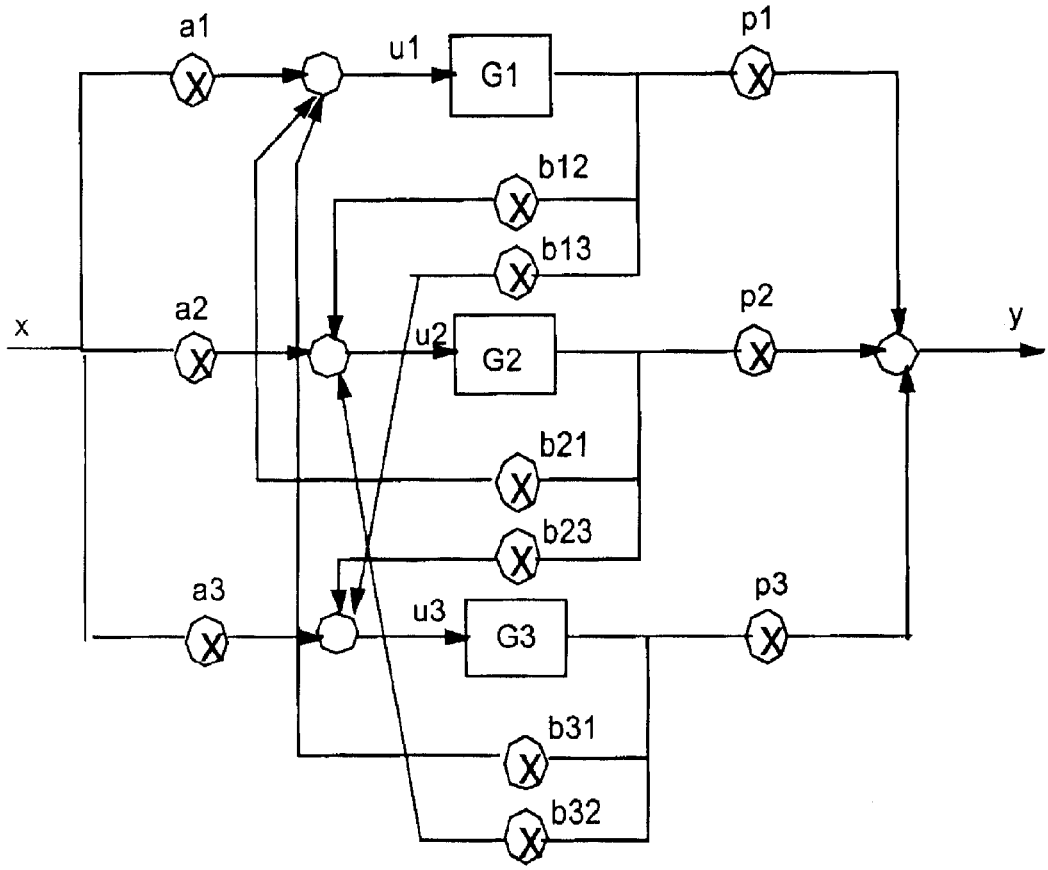
FIG. 2 is a simplified block diagram illustrating a number of noise reduction agents operating within a hearing aid in accordance with the present invention.

In FIG. 2, a specific network configuration is exemplified for three noise reduction agents. Let x be the (recorded) input signal, y the output of the network. $u_i$ the input signal of the i-noise reduction agent, $G_i$ the resulting gain of the i'th noise reduction agent and N the number of noise reduction agents. Then the disclosed network is given by $$u_i = a_i x + \sum_{n=1}^{i-1} b_{ni} G_n u_n + \sum_{n=[1]}^{N} b_{ni} G_n u_n$$

$$y = \sum_{i=1}^{N} p_i G_i u_i$$

The environmental classifier outputs or parameters are now the $a_i$, $b_{ij}$ and $p_i$. The outputs $p_i$ possibly also control parameters within the noise reduction agents. The two phases (training and operative) processing of signals is completely similar as in the above-description disclosure.

The invention claimed is:

1. A hearing prosthesis for a hearing impaired individual, comprising:

an input signal channel providing a digital input signal;

an environmental classifier that is adapted to analyze the digital input signal for predetermined signal features to indicate recognition probabilities for different listening environments, wherein the environmental classifier is not a human; and a processor for producing a noise reduced digital signal based on at least one of the recognition probabilities for at least one of the different listening environments indicated by the environmental classifier, and based at least in part on the hearing impaired individual's signal-to-noise ratio loss.

2. The hearing prosthesis according to claim 1, in which the environmental classifier is configured based on a training-phase parameter set determined during a training phase, so as to obtain a target signal-to-noise ratio improvement.

3. The hearing prosthesis according to claim 2, in which the training-phase parameter set is one of a plurality of parameter sets determined by a training-phase environmental classifier that is of a same type as the environmental classifier of the hearing prosthesis, the plurality of parameter sets correspond with respective target signal-to-noise ratio improvements.

4. The hearing prosthesis according to claim 3, further comprising a persistent data space, wherein the persistent data space of the hearing prosthesis is for storing at least some of the plurality of parameter sets determined by the training-phase environmental classifier, and wherein one of the plurality of parameter sets determined by the training-phase environmental classifier corresponds with the hearing impaired individual's signal-to-noise ratio loss.

5. The hearing prosthesis according to claim 4, wherein the one of the plurality of parameter sets determined by the training-phase environmental classifier is for providing a noise reduction amount which substantially compensates or over compensates the individual's signal-to-noise ratio loss so as to restore or improve the individual's hearing capability and allow the individual to perform at least comparable to an average normal hearing individual in a standardized hearing noise test.

6. The hearing prosthesis according to claim 1, wherein the processor is adapted to control relative noise reduction contributions between a plurality of noise reduction agents to obtain a noise reduction amount.

7. The hearing prosthesis according to claim 6, wherein the plurality of noise reduction agents comprise a cascade of a spatial filtering based noise reduction agent and a single observation based noise reduction agent.

8. The hearing prosthesis according to claim 1, wherein the processor is configured to produce the noise reduced digital signal by regulating respective parameters values of a noise reduction agent and/or by regulating a scaling factor of a gating network.

9. The hearing prosthesis according to claim 1, wherein the processor is configured to produce the noise reduced digital signal by applying a noise reduction amount to the digital input signal, said noise reduction amount being programmable and controllable from a fitting system through adjustment of, or selection of, parameter sets of the environmental classifier.

10. The hearing prosthesis of claim 1, in which the environmental classifier is further configured to:

receive a collection of predetermined sound segments during a training phase, in which the collection of predetermined sound segments is representative of the different listening environments.

11. The hearing prosthesis of claim 1, wherein the noise reduced digital signal is produced by applying a noise reduction amount to the digital input signal, said noise reduction amount having a value that is based on a desired level of improvement in the individual's capability of understanding speech in noise.

12. The hearing prosthesis of claim 11, in which the processor is further configured to distribute the noise reduction amount between two or more noise reduction agents stored in a tangible medium in the hearing prosthesis.

13. The hearing prosthesis of claim 1, in which the hearing prosthesis is configured to utilize a parameter set which is substantially identical to a training-phase parameter set determined during a training phase of a training-phase environmental classifier.

14. The hearing prosthesis of claim 1, wherein the hearing impaired individual's signal-to-noise ratio loss is based on a comparison between the hearing impaired individual's word recognition and a prescribed level of word recognition.

15. The hearing prosthesis of claim 14, wherein the prescribed level of word recognition comprises a measure of correct word recognition in a hearing in noise test.

16. The hearing prosthesis of claim 1, wherein the signal-to-noise ratio loss is determined based on a measurement of the hearing impaired individual's speech reception threshold.

17. The hearing prosthesis of claim 1, wherein the signal-to-noise ratio loss comprises an average increase in signal-to-noise ratio (SNR) needed for the hearing impaired individual relative to a normal hearing person in order to achieve similar performance on a hearing test.

18. The hearing prosthesis of claim 17, wherein the similar performance comprises a 50% word recognition.

19. The hearing prosthesis of claim 1, wherein the processor is further configured to apply a noise reduction amount to the digital input signal, and the environmental classifier is configured to minimize a cost function associated with the application of the noise reduction amount to the digital input signal.

20. A method of fitting a hearing prosthesis to a hearing impaired individual, the method comprising:

providing a data communication link between the hearing prosthesis and a fitting system, the hearing prosthesis having an environmental classifier that is configured to analyze a digital input signal for predetermined signal features to indicate recognition probabilities for different listening environments;

providing data regarding the hearing impaired individual's signal-to-noise ratio loss for determining parameter values of a noise reduction agent of the hearing prosthesis based on at least one of the recognition probabilities for at least one of the different listening environments indicated by the environmental classifier, and based at least in part on the hearing impaired individual's signal-to-noise ratio loss; and storing the parameter values of the noise reduction agent within a persistent data space in the heating prosthesis, whereby the hearing prosthesis is equipped with the parameter values of the noise reduction agent that provides optimal noise reduction in a given sound environment in dependence of the signal-to-noise ratio loss of the heating impaired individual.

21. The method according to claim 20, further comprising training the environmental classifier.

22. The method according to claim 21, wherein the training the environmental classifier comprises using a collection of predetermined sound segments, representative of different listening environments, to produce a collection of noise-reduced sound segments.

23. The method of claim 20, in which the parameter values comprise respective values of noise reduction amounts.

24. The method of claim 20, further comprising:

distributing the parameter values between the noise reduction agent and another noise reduction agent stored in the hearing prosthesis.

25. The method of claim 20, wherein the environmental classifier is not a human.

26. The method of claim 20, wherein the signal-to-noise ratio loss is based on a comparison between the hearing impaired individual's word recognition and a prescribed level of word recognition.

27. The method of claim 20, wherein the signal-to-noise ratio loss comprises an average increase in signal-to-noise ratio (SNR) needed for the hearing impaired individual relative to a normal hearing person in order to achieve similar performance on a hearing test.

28. The method of claim 27, wherein the similar performance comprises a 50% word recognition.

29. A fitting system for fitting a hearing prosthesis for a hearing impaired individual, the hearing prosthesis comprising an environmental classifier that is configured to analyze a digital input signal for predetermined signal features to indicate recognition probabilities for different listening environments, wherein the environmental classifier is not a human, and wherein the fitting system is configured to determine parameter values of a noise reduction agent of the hearing prosthesis based on at least one of the recognition probabilities for at least one of the different listening environments indicated by the environmental classifier, and based at least in part on the hearing impaired individual's signal-to-noise ratio loss in order to produce a noise reduced digital signal within the hearing prosthesis; and store the parameter values within a persistent data space in the hearing prosthesis.

30. The fitting system of claim 29, further comprising a measurement module for measuring the hearing impaired individual's signal-to-noise ratio loss based on a comparison between the hearing impaired individual's word recognition and a prescribed level of word recognition.

31. The fitting system of claim 30, wherein the prescribed level of word recognition comprises a measure of correct word recognition in a hearing in noise test.

32. The fitting system of claim 29, wherein the signal-to-noise ratio loss comprises an average increase in signal-to-noise ratio (SNR) needed for the hearing impaired individual relative to a normal hearing person in order to achieve similar performance on a hearing test.

33. The hearing prosthesis of claim 32, wherein the similar performance comprises a 50% word recognition.

34. The fitting system of claim 29, further comprising an auxiliary measurement module for measuring a speech reception threshold (SRT) from which the signal-to-noise ratio loss is determined.

* * * * *